US007431129B2

(12) United States Patent
Honein

(10) Patent No.: US 7,431,129 B2
(45) Date of Patent: Oct. 7, 2008

(54) COMPOSITE SCAFFOLDING PLANK AND METHOD OF FORMING SAME

(76) Inventor: Joseph Honein, 11040 Jones Rd. West, Houston, TX (US) 77065

( * ) Notice: Subject to any disclaimer, the term of this patent is extended or adjusted under 35 U.S.C. 154(b) by 1355 days.

(21) Appl. No.: 10/035,998

(22) Filed: Dec. 26, 2001

(65) Prior Publication Data

US 2002/0079167 A1 Jun. 27, 2002

Related U.S. Application Data

(63) Continuation of application No. 09/537,606, filed on Mar. 29, 2000, which is a continuation-in-part of application No. 09/320,221, filed on May 26, 1999, which is a continuation-in-part of application No. 08/739,799, filed on Oct. 30, 1996, now abandoned.

(60) Provisional application No. 60/005,774, filed on Oct. 31, 1995.

(51) Int. Cl.
*E04G 5/08* (2006.01)

(52) U.S. Cl. ..... 182/222

(58) Field of Classification Search ..... 182/222, 182/119; 52/223.7; 114/353
See application file for complete search history.

(56) References Cited

U.S. PATENT DOCUMENTS

| | | | |
|---|---|---|---|
| 1,167,988 A | | 1/1916 | Faulkner |
| 2,087,958 A | | 7/1937 | Allen |
| 2,567,191 A | * | 9/1951 | Anguera |
| 2,569,450 A | | 10/1951 | Bouton |
| 2,650,395 A | | 9/1953 | de Anguera |
| 3,099,301 A | | 7/1963 | Bennett |
| 3,144,892 A | | 8/1964 | Webster |
| 4,534,448 A | | 8/1985 | Trainer |
| 5,120,378 A | | 6/1992 | Porter et al. |

FOREIGN PATENT DOCUMENTS

| | | | |
|---|---|---|---|
| DK | 84807 | | 5/1958 |
| EP | 0285787 A1 | | 10/1988 |
| JP | 01267002 A | * | 10/1989 |

* cited by examiner

*Primary Examiner*—Alvin C Chin-Shue
(74) *Attorney, Agent, or Firm*—Kenneth H Johnson

(57) ABSTRACT

A composite scaffolding plank made from a plurality of wooden boards positioned in side to side parallel abutment. A plurality of spaced pins extend transversely through the wooden boards. A cam means on the pins pulls and holds the boards together. In one preferred embodiment where the plurality of wooden boards are from a single board that is ripcut, the strength of the wooden plank is increased by cutting the plank longitudinally, positioning the resulting sections in side to side parallel abutment with the wood grains alternating directions, and to subsequently embedding a plurality of spaced pins in the sections.

13 Claims, 8 Drawing Sheets

*FIG. 7*

| HEE S/N | Side | Date Marked on Board | Test 1 | Test 2 | Test 3 |
|---|---|---|---|---|---|
| | | | Deflection @ 500 lbs,in | Deflection 1 Board @ 500 lbs,in | Max. Load, lbs/Deflection/Failure |
| 1 | A | 12–94 | 1.975 | 2.282 | 1527 lbs/6.385"/simple tension |
| 1 | B | 12–94 | 2.002 | 2.034 | |
| 2 | A | 12–94 | 2.378 | 2.308 | 1648 lbs/7.760"/full deflection reached with no failure |
| 2 | B | 12–94 | 2.508 | 2.271 | |
| 3 | A | 12–94 | 2.157 | 2.124 | 1652 lbs/6.844"/simple tension |
| 3 | B | 12–94 | 1.996 | 2.051 | |
| 4 | A | 11–94 | 2.002 | 2.174 | 1774 lbs/7.438"/full deflection reached with no failure |
| 4 | B | 11–94 | 2.005 | 2.112 | |
| 5 | A | 11–94 | 1.594 | N/A | 2147 lbs/6.785"/cross-grain tension failure |
| 5 | B | 11–94 | 1.810 | N/A | |
| 6 | A | 11–94 | 1.914 | N/A | 1009 lbs/4.275"/simple tension |
| 6 | B | 11–94 | 2.081 | N/A | |

*FIG. 8*

| Comparison Results | | | |
|---|---|---|---|
| | Pinned | Solid | Laminated |
| Modulus of Elasticity | $2.0 \times 10^6$ | $1.8 \times 10^6$ | $2.15 \times 10^6$ |
| Flexural Stress | 2,600 psi | 2,200 psi | 2,900 psi |
| Horizontal Sheer Stress | 120 psi | 90 psi | 145 psi |

*FIG. 9*

| Failure Results | | |
|---|---|---|
| Type of board | Average Failure Load (lbs) | Comments |
| Pinned | 2,700 psi | One member out of three fails first |
| Solid | 2,200 psi | Whole Unit Fails |
| Laminated | 2,400 psi | Whole Unit Fails |

*FIG. 10*

| Deflection Results | | |
|---|---|---|
| Type of board (7 ft span) | Deflection @ 50 psf Load (in) | OSHA Allowable Deflection (in) |
| Pinned | 0.73 | 1.4 |
| Solid | 0.81 | 1.4 |
| Laminated | 0.73 | 1.4 |

COMPOSITE SCAFFOLDING PLANK AND METHOD OF FORMING SAME

CROSS-REFERENCE TO RELATED APPLICATIONS

This application is continuation U.S. Ser. No. 09/537,606, filed Mar. 29, 2000 which is a continuation-in-part of U.S. Ser. No. 09/320,221, filed May 26, 1999, which is a continuation-in-part of U.S. Ser. No. 08/739,799, filed Oct. 30, 1996, now abandoned and claims the benefit of 60/005,774, filed Oct. 31, 1995.

STATEMENT REGARDING FEDERALLY SPONSORED RESEARCH OR DEVELOPMENT

Not applicable.

BACKGROUND OF THE INVENTION

1. Field of Invention

This invention relates to a scaffolding plank. More specifically, it is directed to an improved, low cost wide composite scaffolding plank formed by pinning and anchoring narrow wooden boards in side by side abutment and a method for accomplishing same. The strength of a wooden plank may be improved by cutting the plank longitudinally, alternating the wood grains of the plank sections and pinning the plank sections together as described above.

2. Related Art

Prior to this invention, two types of scaffolding planks existed in the prior art: the solid single board plank and the laminated plank. The solid single board plank comprises one wide wooden board. The laminated plank is constructed from multiple layers of wooden strips glued together. Each of the two types of prior art scaffolding planks has disadvantages.

Due to the limited resources of old growth forests and the harvesting schemes for new growth timber, the yield of wooden boards wide enough from which to construct a solid single board plank is decreasing. Typically, only the center portion of a large tree is sufficiently broad to produce a solid single board plank. Thus, with decreasing yield, the solid single board planks are becoming more costly and difficult to make. The main disadvantage of laminated planks is that laminated planks primarily consist of glued layers of wooden strips, which glued layers of wooden strips absorb substantial amounts of moisture. After absorbing enough moisture, the wooden fibers of the laminated plank soften and the moisture hastens the decay of the laminated plank. Likewise, any time one of the veneers of the laminated plank cracks, the laminated plank looses its strength and consistency and can also no longer be used as a scaffolding. Thus, there has existed a need for a scaffolding plank that is as strong and as durable as a solid single board plank, that does not require the use of wider trees, and that does not have the weaknesses inherent in laminated planks. It would thus be beneficial to the prior art to construct a scaffolding plank that is as strong and as durable as a solid single board plank, that does not require the use of wider trees, and that does not have the weaknesses inherent in laminated planks.

Scaffolding planks are however strictly regulated. The Occupational Safety and Health Administration, OSHA, as well as the Southern Pine Inspection Bureau, SPIB, outline strict standards for scaffolding planks. Pursuant to such regulations, scaffolding planks must comply with certain width, breakage, and quality standards. The OSHA and SPIB standards are strict because workers entrust their lives to the scaffolding. The prior art would thus benefit from a scaffolding plank, as described above, that meets and preferably exceeds the OSHA and SPIB standards. The OSHA standard found at 19 C.F.R. § 1926, Subpart L, including Appendix A, recommends scaffolding for typical medium loads to be 2"×10" (nominal). (Dimensions described in this specification are nominal dimensions, unless otherwise stated. Nominal dimension units are typically ½" greater than actual size dimensions.)

Because the lives of workers hinge on the integrity of scaffolding planks, any safety factors that can be added to a scaffolding plank greatly enhance the value of the scaffolding plank. It would be beneficial to the prior art to provide a scaffolding plank, as described above, which also includes an additional worker safety factor.

Manufactured wide boards for scaffolding are unknown to the prior art. Prior references, however, disclose structural wood assemblies formed from a plurality of smaller wood boards. Illustrative of such wood assemblies are U.S. Pat. No. 2,650,395 that issued to de Anguera on Sep. 1, 1953, U.S. Pat. No. 5,120,378 that issued to Porter et al. on Jun. 9, 1992, U.S. Pat. No. 4,534,448 that issued to Trainer on Aug. 13, 1985, U.S. Pat. No. 1,167,988 that issued to Faulkner on Jan. 11, 1916, and U.S. Pat. No. 2,569,450 that issued to Bouton on Oct. 2, 1951. None of these devices provides a truly simple remedy for the problem of providing manufactured wide boards that can meet the OSHA standards for scaffolding.

The assembly shown in U.S. Pat. No. 2,650,395 discloses a method of forming wood flooring from relatively narrow pieces of wood having varying lengths. The pieces of wood are placed in a number of parallel rows wherein the pieces are placed end to end. A plurality of spaced thin connector keys is driven into lateral bores in the aligned pieces and holds the pieces together.

U.S. Pat. No. 5,120,378 discloses an apparatus and method for producing a prestressed wood material beam. The wood beams are held together using adhesives or mechanical fasteners such as nails or staples.

The other cited references, including those below, disclose wood panels, such as used for bowling alley lanes or structural walls, or walking surfaces comprising loosely associated narrow planks. None of the completed structures teach the wooden components being held together in compression.

U.S. Pat. No. 3,144,892, issued Aug. 18, 1964 to Webster, discloses and claims a method of fabricating panels that are formed by attaching a plurality of boards with relatively soft metal dowels. The dowels are driven into aligning bores that have been drilled through the narrow boards. Webster differs or teaches away from the present invention by having at least three significant limitations. First, Webster orients the plurality of boards such that their wider sides are contiguous. The present invention orients the boards so that their narrower sides are contiguous. This orientation is difficult to achieve without splitting the boards, but is achieved by the disclosed method. Second, Webster uses boards that have a tongue-and-groove channeling between boards to align them. The present method uses flat boards that are aligned with flat sides adjacent and tightly positioned together by the disclosed board pinning machine. Webster further requires tongue-and-groove channeling for releasing cuttings from bores during the drilling operation. Third, Webster uses the groove channels in the boards to "function as lead holes for starting the drill tips into each succeeding panel component" when drilling bores for the securing metal dowels. The present invention, due in part to its board pinning machine securely holding the boards, bores holes directly through the smaller boards without the need for pilot or lead holes.

Danish Patent 84807, published May 5, 1958 and issued to Larsen discloses a system of attaching scaffolding boards at their contiguous ends. Larsen does not teach pinning of the boards together to form a single plank. Rather, Larsen teaches a system of U-shaped clamps that hook into the ends of each scaffold board for wood framed scaffolding, thus aligning the boards into a smooth walk surface. Larsen teaches this by aligning each pair of boards' ends over a wooden support beam, and hooking the U-shaped clamps through holes in the boards and around the support beam. Transverse connecting irons are used solely for the purpose of providing a resting support for the U-shaped clamps, and do not teach pinning the boards together. This system provides a loose connection of several boards, without forming a single plank as described in the present invention. Further, Larsen is limited to specific sized support cross-beams (typically 4"×4" nominal) to mate properly with the U-shaped clamps.

Though the above mentioned devices and assemblies may be helpful for their intended purposes, none disclose a manufactured scaffolding plank that meets OSHA and SPIB requirements, that is as strong and as durable as a solid single board plank, that does not require the use of wider trees, and that does not have the weaknesses inherent in laminated planks.

BRIEF SUMMARY OF THE INVENTION

Accordingly, the objectives of this invention are to provide, inter alia, a composite scaffolding plank and method of forming same that:

- provides a scaffolding board that meets the OSHA requirements;
- is as strong and as durable as a solid single board plank, does not require the use of wider trees, and does not have the weaknesses inherent in laminated planks;
- utilizes a plurality of relatively narrow boards to form a relatively wide board;
- includes a tensioning device that compresses the boards together and prevents their separating;
- creates a safer scaffold board by providing spaced connectors such that, when one of the members of the scaffold board breaks, that member and the remainder of the scaffolding board remain solid beyond the nearest connector;
- creates a safer scaffold board by providing separate parallel boards such that a break initiated by an imperfection in one of the narrow boards will not spread to the connected narrow boards;
- facilitates alternating the wood grains of a board to create a stronger scaffolding board;
- affords an inexpensive source for relatively wide boards and alleviates the scarcity of wide boards; and
- is easily and inexpensively manufactured from readily available resources.

Other objects of the invention will become apparent from time to time throughout the specification and claims as hereinafter related.

To achieve such improvements, my invention is a composite scaffolding plank made from a plurality of wooden boards positioned in side to side parallel abutment. A plurality of spaced pins extends transversely through the wooden boards. A cam means on the pins pulls and holds the boards together. In addition, my invention is a method of forming wide wooden planks from two or more narrow wooden boards by positioning the boards in side to side parallel abutment and embedding a plurality of spaced pins transversely through the boards. Further, a method of increasing the strength of a wooden plank is to cut the plank longitudinally, position the resulting sections in side to side parallel abutment with the wood grains alternating directions, and to subsequently embed a plurality of spaced pins in the sections.

BRIEF DESCRIPTION OF THE DRAWINGS

The manner in which these objectives and other desirable characteristics can be obtained is explained in the following description and attached drawings in which:

FIG. 7 is a table showing the results of a set of tests performed on the composite scaffolding boards.

FIG. 8 is a table showing the results of another set of tests performed on the composite scaffolding boards.

FIG. 9 is a table showing the results of another set of tests performed on the composite scaffolding boards.

FIG. 10 is a table showing the results of another set of tests performed on the composite scaffolding boards.

DETAILED DESCRIPTION OF THE INVENTION

Figure 1:
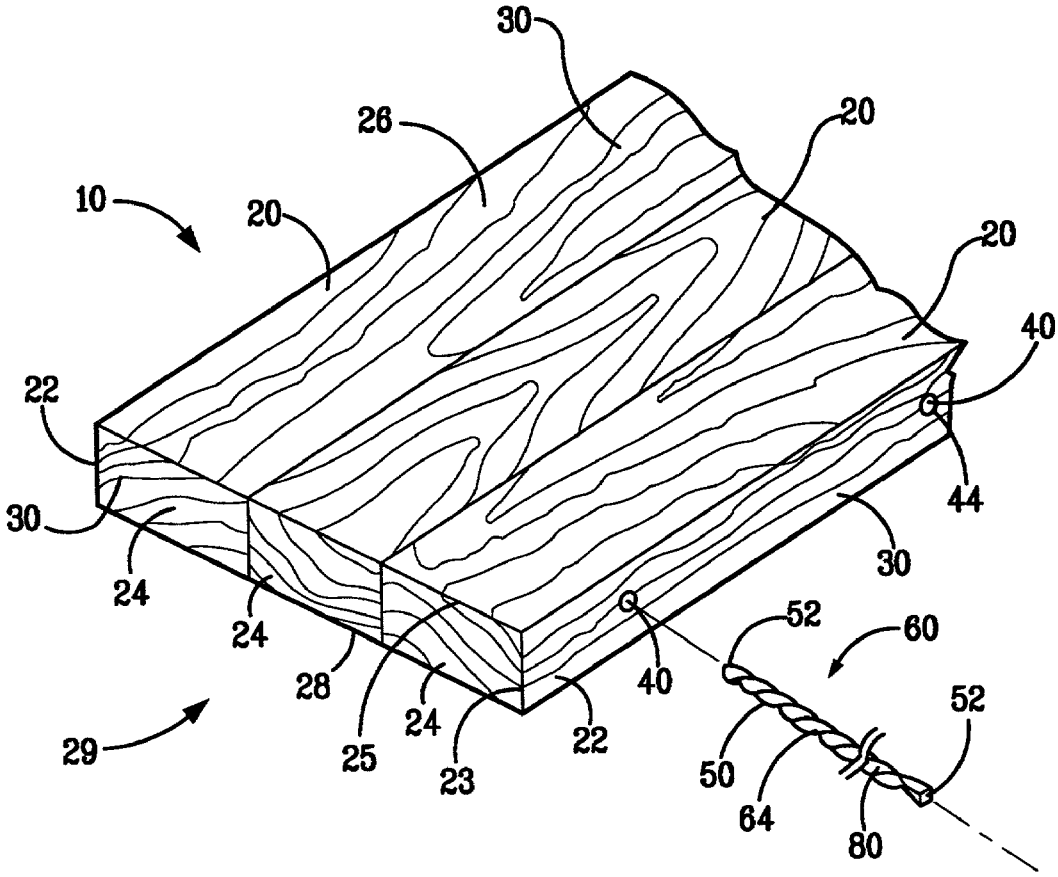
FIG. 1 is a partial isometric exploded view of the composite scaffolding plank showing the pin removed from the bore.
Figure 2:
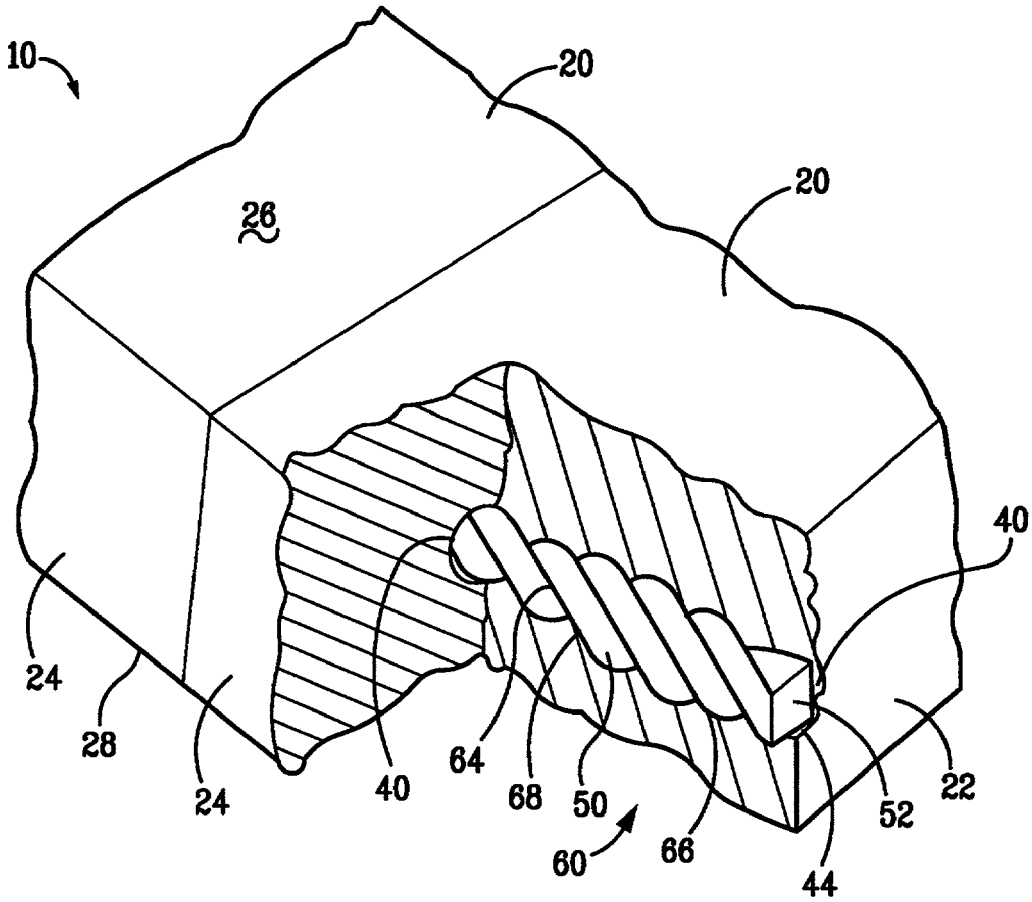
FIG. 2 is a partial cross sectional isometric view of the scaffolding plank showing the pin in the bore.

The preferred embodiment of my invention is illustrated in FIGS. 1 through 10 and the composite scaffolding plank is depicted as 10. Generally, the composite scaffolding plank 10 is formed from a plurality of wooden boards 20 held in tight side to side abutment by a plurality of spaced pins 50 that include a cam means 60 thereon.

Each of the wooden boards 20 has a rectangular prism shape having a length, a top surface 26, a bottom surface 28, two opposing side surfaces 22, and two opposing end surfaces 24. Typically, the wooden boards 20 are elongated in a lengthwise direction measured from end surface 24 to opposing end surface 24. The opposing side surfaces 22 extend parallel to the lengthwise direction and preferably normal to the end surfaces 24. Preferably, the wooden boards 20 are not artificially manufactured and, thus, include wood grains 30 (i.e. aligned wood fibers that, in a piece of dressed wood, rise to the surface in a particular direction).

In the composite scaffolding plank 10, the plurality of wooden boards 20 are positioned in side to side parallel abutment. Typically, the wooden boards 20 and/or their opposing side surfaces 22 have a substantially equal height 23, measured as the perpendicular distance from top surface 26 to bottom surface 28. Consequently, when positioned as described above, the wooden boards 20 form a substantially flat continuous surface along their top surfaces 26. The sides of the wooden boards 20 are relatively flat such that adjacent wooden boards 20 are in contact along their full length. Preferably, the end surfaces 24 of the wooden boards 20 are aligned so that their end surfaces 24 form a substantially continuous surface. Therefore, when formed of wooden boards 20 having substantially equal lengths, each end surface 24 of the composite scaffolding plank 10 form a substantially continuous surface. In the preferred embodiment, height 23 of each wooden board 20 is the smallest dimension of that board 20, including that compared with width 25 of each top surface 26.

A plurality of spaced pins 50 extend substantially through the wooden boards 20 in a substantially transverse direction, normal to the opposing side surfaces 22 and normal to the lengthwise direction of the wooden boards 20. The pins 50 preferably extend the full width of the composite scaffolding plank 10.

Attached to each of the pins 50 is a cam means 60 for pulling and holding the wooden boards 20 together. Preferably, the cam means 60 is an integral helical thread 64 that extends the length of each pin 50.

In the preferred embodiment, the pins are twist lock pins 80. The twist lock pins 80 are formed from an elongated piece of metal having a square cross section, the square. A torque applied to the square twists and plastically deforms the square. After deformation, the corners of the original square form the helical thread 64 of the twist lock pin 80 and form the outer diameter of the helical thread 64. In addition, the center portion of the sides of the square form the root diameter of the helical thread 64. However, the helical threads 64 may comprise conventionally cut threading.

As each pin 50 presses into the wooden boards 20, the helical thread 64 embeds into the wooden boards 20 and causes the pin 50 to rotate. The pin 50 turns and pulls the wooden boards 20 together. Further, because the helical threads 64 embed into the wooden boards 20, the helical threads 64 anchor the pin 50 in position and hold the wooden boards 20 together. Typically, while the pins 50 are inserted, an external force presses the wooden boards 20 laterally together slightly compressing the wooden boards 20 and forcing the opposing side surfaces 22 into tight abutment. As a consequence, when the external force is removed, the wooden boards 20 are now held in compression by the tension in the anchored pins 50. The tension prevents separation of the wooden boards 20 and holds them in tight abutment.

Preferably, the aligned wooden boards 20 have a plurality of transverse bores 40 extending substantially therethrough to facilitate placement of the pins 50 in the wooden boards 20. Thus, the bores 40 are provided before placement of the pins 50 in the wooden boards 20. The bores 40 are aligned such that each bore extends substantially the full width of the composite scaffolding plank 10. A corresponding aperture 44 in at least one of the opposing side surfaces 22 of the composite scaffolding plank 10 for each of the bores 40 provides access to the bore 40 and a place of entry for the corresponding pin 50. The outer diameter of the helical thread 64 is greater than the diameter of the bore 40; and the root diameter of the helical thread 64 is preferably less than the diameter of the bore 40. Whereby, the helical thread 64 embeds in the wooden boards 20 as the pin 50 is pressed into the bore 40.

Although the composite scaffolding plank 10 may be formed of any number of wooden boards 20 having virtually any width, the preferred embodiment of the composite scaffolding plank 10 includes three (3) wooden boards 20 each having a height 23 of two (2) inches and a width 25 of four (4) inches. In this way, the composite scaffolding plank 10 is made of conventionally sized and readily available wooden boards 20 that form a composite scaffolding plank 10 having a height 23 of two (2) inches and a width 25 of twelve (12) inches. In a second preferred embodiment, composite scaffolding plank 10 may be formed of any number of wooden boards 20 having height 23 of 2" (nominal) a combined width 29 of 10" (nominal). In this second preferred embodiment, the 10" nominal combined width 29 is preferably achieved by two outer boards having widths 25 of 3½" actual, and a center board having width 25 of 2½" actual, to give a combined nominal width of 10" (9½" actual). In the preferred embodiment, the center board is oriented such that its wood grain is opposed to that of the outer boards. It is noted that any combination of boards may be used if the combination leads to a usable scaffolding plank. Typical alternative heights 23 are 1⅝", 1¾" and 2" (all actual dimensions). Typical alternative combined widths 29 are 10½", 11" and 12" (all actual dimensions).

The method for forming wide wooden planks 10 from two or more wooden boards 20, generally, includes positioning the wooden boards 20 in side to side parallel abutment and subsequently embedding a plurality of spaced pins 50 substantially through the wooden boards 20.

Figure 3:
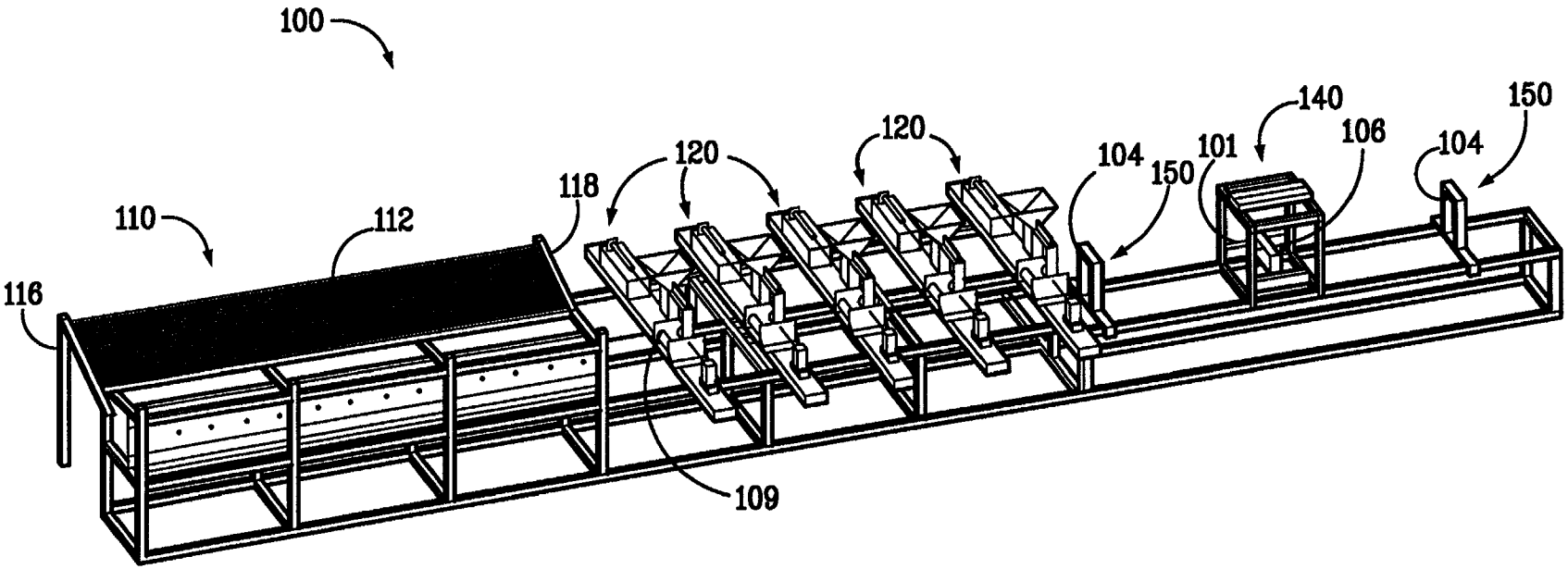
FIG. 3 is an isometric view of the scaffold board pinning machine.
Figure 4:
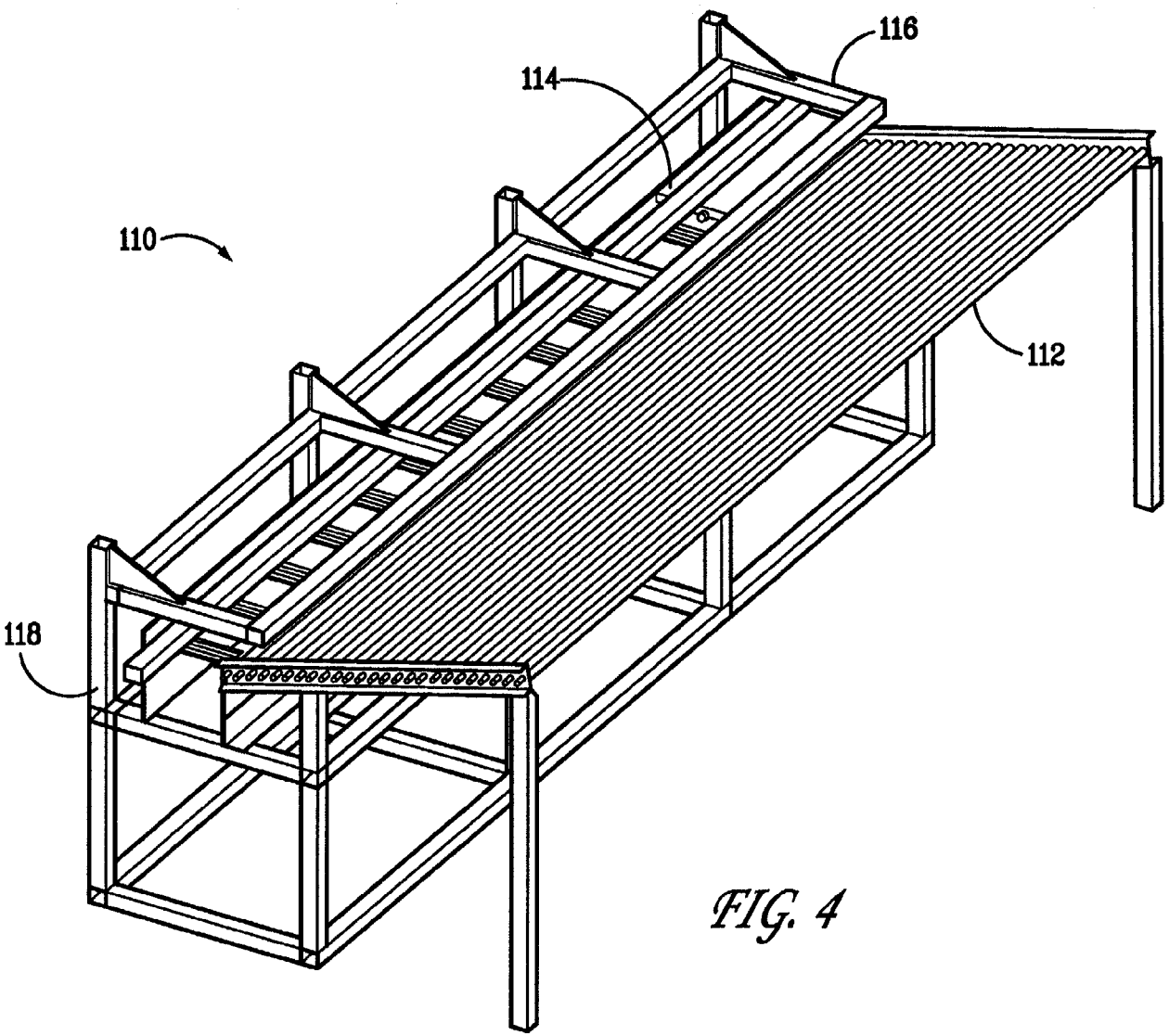
FIG. 4 is an isometric view of the loading station.
Figure 5:
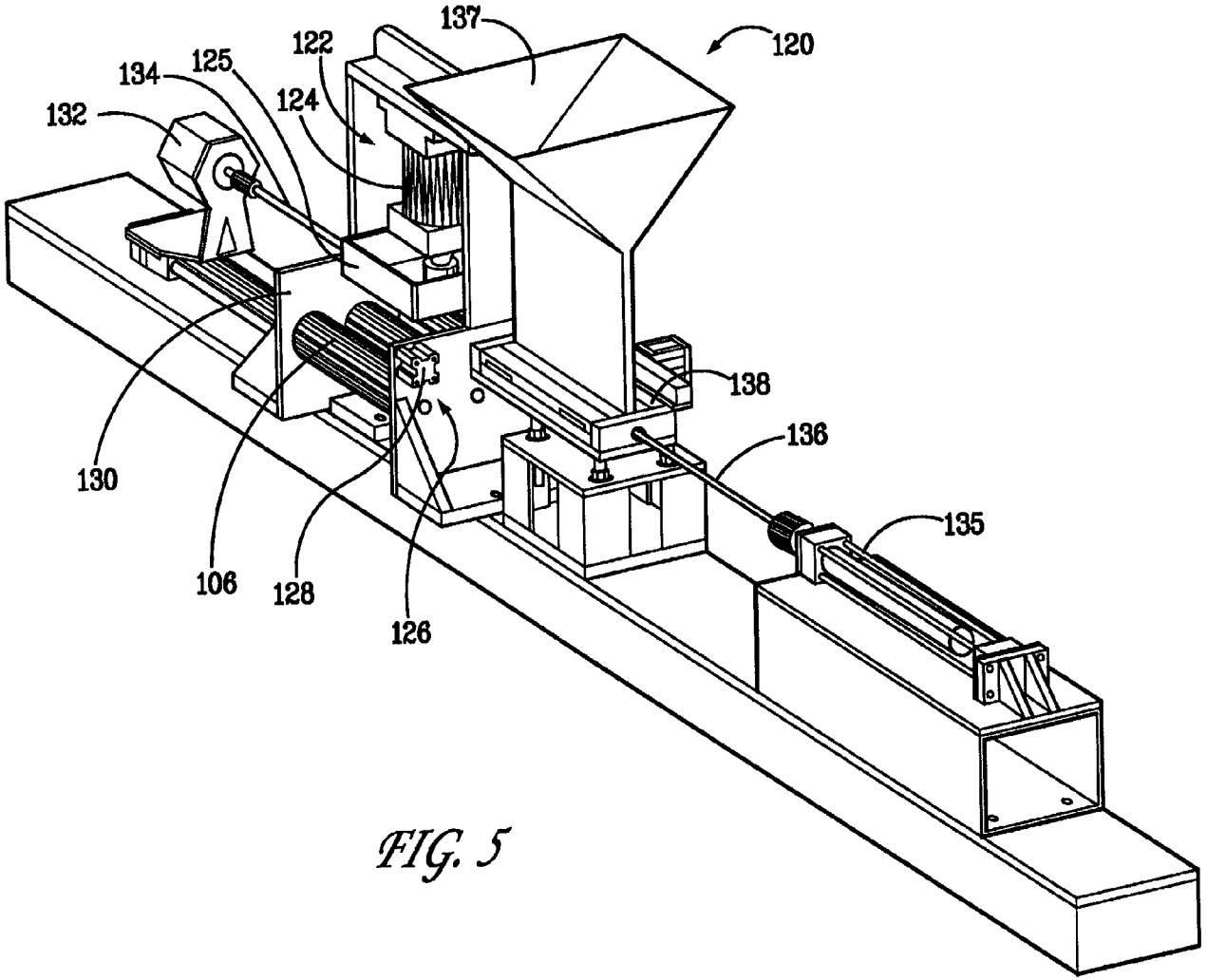
FIG. 5 is an isometric view of a pinning station.
Figure 6:
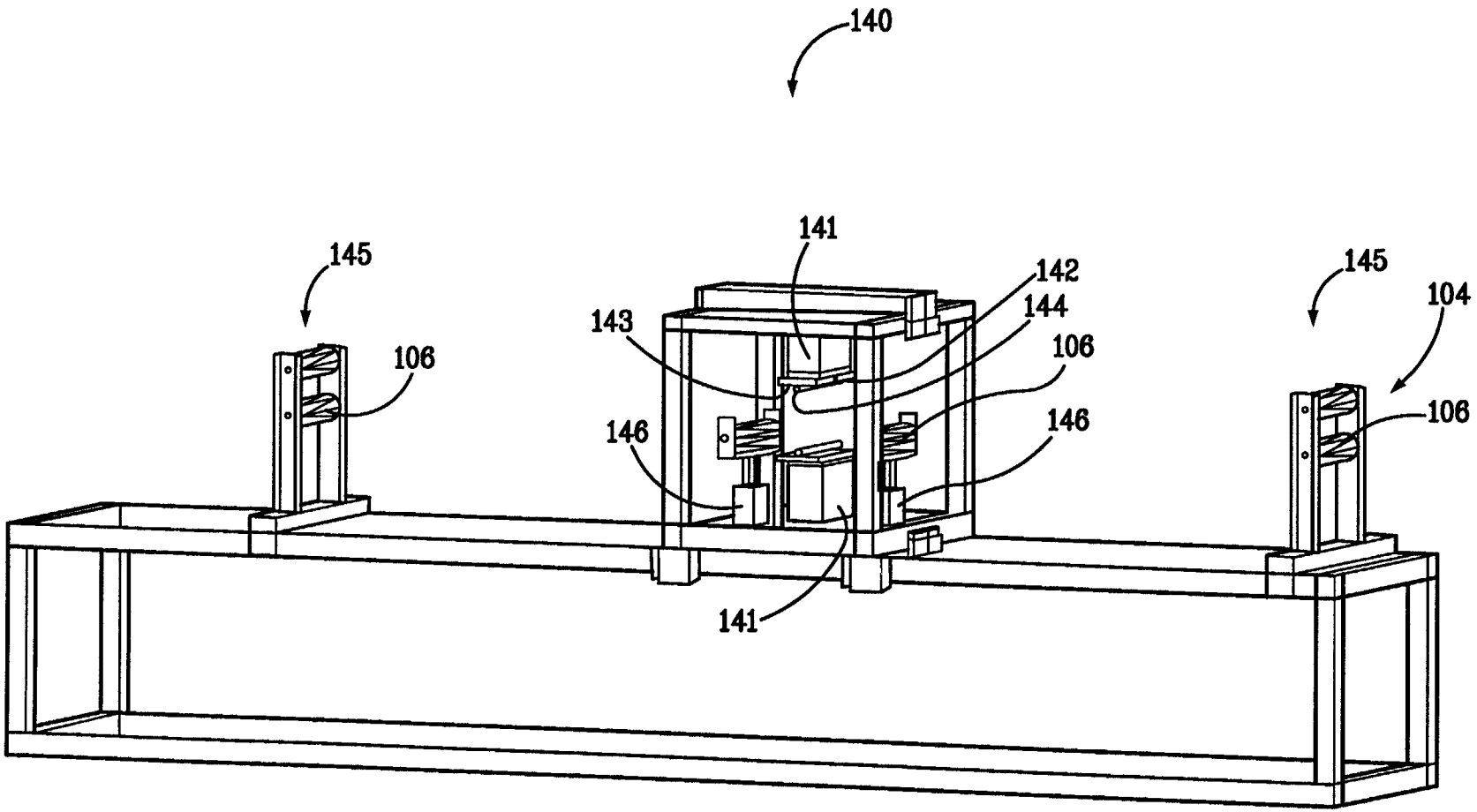
FIG. 6 is an isometric view of the testing station.

The method is accomplished using a scaffold board pinning machine 100 similar to that shown in FIG. 3. As shown, the machine includes a loading station 110, one or more spaced pinning stations 120, a testing station 140, and a conveyance means 150 for moving the wooden boards 20 through the scaffold board pinning machine 100.

The wooden boards 20 slide down an inclined roller deck 112 onto the roller bed 104 of the scaffold board pinning machine 100. The boards 20 enter the roller bed 104 in side to side parallel arrangement.

The roller bed 104 is made of a plurality of rollers 106 held in a horizontal plane and positioned such that their axes are normal to the longitudinal direction of the wooden boards 10 positioned thereon. The rollers 106 of the roller bed 104 are positioned on each component of the scaffold board pinning machine 100 and are free to rotate about their respective axes. The rollers 106 may include one or more drive motors that turn the rollers 106 and thereby move the wooden boards 20 supported thereon and, thereby, provide the conveyance means 150.

Alternatively, the preferred embodiment utilizes a hydraulic or pneumatic cylinder 114 positioned proximal the rear end 116 of the loading station 110 to provide the conveyance means 150. Once the boards 20 enter the roller bed 104, the cylinder 114 simultaneously forces all of the boards 20 over the rollers 106 from the loading station 110 toward its forward end 118. Because the cylinder 114 forces all of the boards 20 simultaneously, the cylinder 114 aligns the end surfaces 24 of the boards 20. Thus, the loading station 110 and conveyance means 150 may serve to align the wooden boards 20 such that their end surfaces 24 form a substantially continuous surface. Subsequent sets of boards 20 advance the previous sets over the roller bed 104.

From the loading station 110, the boards 20 enter one or more spaced pinning stations 120. Preferably, the scaffold board pinning machine 100 includes a plurality of pinning stations 120 the number of which equals the predetermined number of pins 50 for each composite scaffolding plank 10. Commonly, the pins 50 are spaced every twenty inches. Thus, for example, a ten foot long composite scaffolding plank 10 would include five pins 50; and the scaffold board pinning machine 100 for making the ten foot long composite scaffolding plank 10 would include at least five pinning stations 120. The preferred number of pinning stations 120 is five (5).

The pinning station 120 includes a horizontal compression means 126, a vertical compression means 122, a drill 132, a pin holder 138, and a pin press 135. In operation, the pinning station 120 compresses the boards 20 transversely and vertically. The vertical compression maintains the relative position of the boards 20 while the scaffold board pinning machine 100 embeds the pins 50. The pinning station 120 drills a plurality of lateral bores 40 through the aligned boards 20 to facilitate the embedding of the pins 50. Finally, the pinning machine embeds the pins 50 transversely through the boards 20.

Typically, the vertical compression means 122 is a hydraulic or pneumatic vertically mounted cylinder 124 that has a relatively wide ram head 125. With the boards 20 in place, the vertically mounted cylinder 124 activates such that the ram head 125 engages the top surface 26 of the boards 20. The ram head 125 is sufficiently wide that it engages all of the boards 20 simultaneously and holds the boards 20 between the ram head and the rollers 106.

The horizontal compression means 126 is generally one or more hydraulic or pneumatic horizontally mounted cylinders 128. With the boards 20 in place, the horizontally mounted cylinder 128 engages and compresses the boards 20. Therefore, in addition to providing the desired compression, the horizontally mounted cylinder 128 maintains the relative position of the boards 20 during drilling of the bores 40 and embedding of the pins 50.

Once held in position, the drill 132 activates and drills a lateral bore 40 completely through the aligned boards 20. The drill 132 is positioned on the pinning station 120 such that the drill bit 134 engages one of the opposing side surfaces 22 of the nearest board 20 normal to the side surface 22. In the preferred embodiment, drill bit 134 has a tip angle, preferably in the range of 111° to 112° measured off a plane normal to the axis of drill bit 134, that allows a cutting speed that is practical and fast while avoiding the splitting of boards 20. Upon completion of the drilling, the drill 132 retracts the drill bit 134 from the boards 20.

The pins 50 are gravity fed through a pin hopper 137 to a pin holder 138. The pin holder 138 maintains the pin 20 in a position aligned with the bores 40 (i.e. lateral to the opposing side surfaces 22 of the boards 20 and positioned approximately midway between the top surface 26 and bottom surface 28 of the boards 20).

The pin press 135 is typically a hydraulic or pneumatic cylinder constructed and is positioned to exert a force on the pin 50 sufficient to push the pin 50 into the bore 40. Preferably, the pin press 135 is mounted opposite the drill 132 on the pinning station 120 with the axis of the drill bit 134 and the axis of the pin press ram 136 substantially aligned. Thus, the drill 132 drills the bore 40 from one side surface 22 of the boards 20; and the pin press 135 forces the pin 50 into the bore 40 from the opposite side surface 22 of the boards 20. As previously stated, the pins 50 include a cam means 60, which embeds into the boards 20 as the pin 50 is placed therein. The cam means 60 acts as an anchor maintaining the pin 50 within the boards 20 as well as maintaining the relative position of the boards 20.

After the pin 50 is embedded into the boards 20, the vertical compression means 122 and the horizontal compression means 126 disengage. With the boards 20 no longer compressed by horizontal compression means 126, boards 20 are now held together in compression by pins 50 embedded within the boards 20.

Once released from the pinning stations 120, the conveyance means 150 advances the composite scaffolding plank 10 to the testing station 140. The composite scaffolding plank 10 advances until it is substantially centered in the testing station 140. When centered, a pair of spaced supports 145 each having a pair of rollers 106 support the composite scaffolding plank 10. The pair of rollers 106 of the supports 145 are vertically aligned to support the composite scaffolding plank 10 during both upward and downward testing.

Two vertically mounted hydraulic or pneumatic testing cylinders 141 are positioned substantially equidistant between the supports 145. One of the testing cylinders 141 is positioned above the composite scaffolding board 10 to exert a downward force thereon; and the other testing cylinder 141 is positioned below the composite scaffolding board 10 to exert an upward force thereon. The testing cylinders 141 are mounted with their rams 142 positioned so that, upon actuation, the rams 142 exert a force on the composite scaffolding plank 10. A contact rod 144 attached to the ram contact surface 143 extends in a direction transverse to the lengthwise direction of the composite scaffolding plank 10 being tested. Thus, when each testing cylinder 141 is actuated, the respective contact rod 144 exerts a force on the composite scaffolding plank 10 that is substantially a transverse line. Preferably, the magnitude of the force is 500 pounds or more.

To accommodate for the weight of the composite scaffolding plank 10 during testing in the upward direction, the testing station 140 includes compensating cylinders 146 that have rollers thereon. When testing in the upward direction, the compensating cylinders 146 lift the composite scaffolding plank 10 until it contacts the upper rollers 106 of the supports 145. In this way, the lower testing cylinder 141 is not lifting the composite scaffolding plank 10 during the upward test. After the test, the compensating cylinders 146 lower the scaffolding plank 10 onto the lower rollers 106 of the supports 145. The compensating cylinders 146 retract sufficiently that they do not contact the composite scaffolding plank 10 during its downward testing.

After sequentially testing the composite scaffolding board 10 in both directions, the testing cylinder 141 releases the force on the composite scaffolding plank 10 and the conveyance means 150 advances the composite scaffolding plank 10 from the scaffold board pinning machine 100. Only one of the testing cylinders 141 is actuated at a time to permit testing of the composite scaffolding plank 10 in both directions.

Although the preferred embodiment of the testing station 140 includes two testing cylinders 141, it may use only one testing cylinder 141. In that event, however, the composite scaffolding plank 10 must be manually turned to test both sides of the plank 10.

The above described machine and method may be applied to a wide wooden plank to increase the strength and the safety of the plank. To increase the strength of the plank, it is first cut longitudinally into a plurality of wooden plank sections 20, preferably three (3). The wooden plank sections 20 are placed in side to side parallel abutment. However, the alignment of the wood grains 30 of the wooden plank sections 20 are alternated such that the direction of the wood grains 30 of adjacent wooden plank sections 20 alternates. The wooden plank sections 30 are then reattached as described above using embedded pins 50. When reconnected, the composite scaffolding plank 10 has greater strength than the original wooden plank because the wood grains 30 oppose one another. Further, a failure in one of the wooden plank sections 20 will not spread to adjacent wooden plank sections 20.

Test Results. A series of tests comparing the load capacity and deflection of composite scaffolding planks 10 and solid wide boards (hereinafter collectively referred to as "planks") show that the composite scaffolding planks 10 perform substantially as well as, if not better than, solid wide boards. The tests were conducted utilizing an INSTRON 4507 (serial number H1963) testing machine. Four composite scaffolding planks 10, each having a height of two inches and a width of twelve inches and made from three two-by-fours, and two solid two-by-twelve's, having similar overall dimensions were individually tested under the same conditions.

The planks rested in the INSTRON machine on supports proximal the plank ends. The INSTRON machine then applied a downward force on the planks. A rod on the end of the ram of the INSTRON machine cylinder provided a downward load across the width of the planks at a position near the midpoint of the supports. First, the INSTRON machine measured the deflection of each plank when subjected to a load of 500 pounds. Next, for the composite scaffolding planks 10, the INSTRON machine measured the deflection of each composite scaffolding plank 10 when subjected to a load of 500 pounds concentrated on a single board 20. Each of these first two tests was performed on both sides of each plank. Finally, the INSTRON machine measured the maximum load to failure and the deflection at failure for each of the planks. The results of the test are shown in FIG. 7.

As shown by the test results, the composite scaffolding planks 10 are slightly less rigid (having a higher modulus of elasticity) and less brittle (having a greater fiber strength) and, thus, can withstand greater deflection before failure than the solid boards. Further, the composite scaffolding planks 10 tested have a higher average capacity than the solid wide boards tested. Consequently, the composite scaffolding boards 10 performed better under load than the solid wide boards.

Additional tests have also been performed as tabulated in FIG. 8. Among others, the flexural stress, modulus of elasticity, horizontal shear stress, coefficient of variation, and maximum deflection of the composite scaffolding plank 10 were tested and compared. The results tabulated in FIG. 8 correspond to a test which compared a Dense Industrial 65 Scaffold Plank, which is a very common type and grade of single board plank in the field today, against a composite scaffolding plank 10 having the same dimensions as well as a laminated plank having the same dimensions. From the comparison results, it is clear that the composite scaffolding plank 10 not only has a greater modulus of elasticity than the solid single board plank, but that the composite scaffolding plank 10 can also withstand more flexural and horizontal shear stress than the solid single board plank before breaking. In addition, FIG. 8 shows that the composite scaffolding plank 10 is relatively close to the laminated plank in respect to modulus of elasticity, flexural stress, and horizontal shear stress.

FIG. 9 tabulates and compares the failure test results of the same type of boards. As can be seen, the composite scaffolding plank 10 fails at a higher load per square inch than comparable solid single board and laminated planks. Thus, the composite scaffolding plank 10 can withstand greater force before breaking when using similar Dense Industrial 65 type wood. The preferred wood used in composite scaffolding plank 10 has a fiber bending ($F_b$) of at least 2200 PSI, with a Modulus of Elasticity (E) in the range of $1.6\times10^6$ to $1.8\times10^6$, preferably $1.8\times10^6$.

FIG. 10 tabulates and compares the deflection results on the same type of boards given a loading of 50 pounds per square foot. As can be seen, the composite scaffolding plank 10 deflects the same distance as the laminated plank and much less than the solid single board plank at the same load. Further, FIG. 10 illustrates that each type of board is well within the OSHA allowable deflection at that load rating. The composite scaffolding plank 10 also is well within the OSHA allowable deflection at all other load ratings.

Other Advantages and Results. The Applicant has achieved the objectives of this invention by pinning a plurality of wooden boards 20 together with pins 50. Specifically, the wooden boards 20 are pinned together transversely through their smallest dimension. It is understood, however, that at the time of the invention many people in the industry thought that manufacturing a scaffolding plank by pinning wooden boards together transversely to their smallest dimension would result in the splitting of the wooden boards. Applicant has been recognized by many in the industry as the first to successfully pin wooden boards together transversely to their smallest dimension without splitting any of the wooden boards.

Applicant's invention is even more significant since the composite plank 10 meets and exceeds prevailing OSHA and SPIB requirements and actually, for the most part, outperforms prior art planks. In addition, Applicant's composite plank 10 has achieved substantial commercial success. Due to its long-felt need, stellar performance, and commercial success, the composite plank 10 is now recognized as the third type of scaffolding plank by renowned industry organizations, such as the Carpenter's Union, the Scaffold Industry Association, and the Masonry Construction Magazine.

The use of pinned narrower wooden boards 20 also inherently increases the strength of the composite plank 10. Under OSHA standards, the size of knots allowable in narrower boards is much smaller than that allowable in wider boards. Knots are inherent weak points in wooden boards. Thus, the use of narrower boards, which necessarily must have smaller knots to comply with OSHA regulations, increases the overall strength of the composite plank 10.

The use of boards 20 with smaller knots in conjunction with the spaced apart pinning of such boards 20 creates a sharing of load on the composite plank 10 which increases the overall strength of the composite plank 10 up to 20%.

The use of multiple narrower wooden boards 20 pinned together also creates an additional worker safety factor that is unique to the composite plank 10. When the composite plank 10 is overstressed to the point of failure, only one of the wooden boards 20 will normally break and such board 20 will normally break only up to the nearest pin 50. The worker standing on the composite plank 10 can hear and see the single wooden board 20 breaking, allowing the worker enough time to get to safety. Prior art scaffolding planks do not have this worker safety factor. When a prior art scaffolding plank breaks, the failure is typically sudden putting the life of the worker in danger. The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A composite scaffolding plank comprising:

a plurality of wooden boards each having a fiber bending value of at least 2200 psi, a modulus of elasticity in the range of $1.6\times10^6$ to $1.8\times10^6$, a lengthwise direction, two opposing sides being flat and extending parallel to said lengthwise direction, each of said sides having a height, said height being the smallest dimension of said wooden boards;

said plurality of wooden boards positioned in side to side parallel abutment;

at least three bores extending through said plurality of wooden boards;

at least three spaced helical pins extending transversely through and imbedded in said bores in said plurality of wooden boards, said plurality of wooden boards being under compression, normal to said wooden board sides and normal to said lengthwise direction; and said plurality of wooden boards being held together in compression by said helical pins.

2. A composite scaffolding plank as in claim 1 wherein said plurality of wooden boards comprise three of said wooden boards.

3. A composite scaffolding plank as in claim 1 wherein:

each of said plurality of wooden boards having a length and including a top and two opposing ends;

said wooden board tops being co-planar;

said wooden board lengths being substantially equal; and said wooden board ends forming a substantially continuous surface.

4. A composite scaffolding plank as in claim 1 further comprising:

said plurality of wooden boards having a transverse bore extending substantially therethrough for each of said helical pins;

so that said transverse bore facilitates placement of said corresponding helical pin in said plurality of wooden boards.

5. A composite scaffolding plank as in claim 1, wherein each of said at least three spaced helical pins has a square cross section.

6. A composite scaffolding plank as in claim 2, wherein said three wooden boards comprise a middle board and two outer boards;

said three wooden boards each having a wood grain direction; wherein said middle board is oriented such that the direction of said wood grain of said middle board alternates against said wood grain direction of said two outer boards.

7. A composite scaffolding plank comprising:

a plurality of wooden boards;

each said wooden board having a fiber bending value of at least 2200 psi, a modulus of elasticity in the range of $1.6\times10^6$ to $1.8\times10^6$ and a rectangular prism shape;

each said wooden board having a length, a first end surface, a second end surface, a top surface, a bottom surface, and two opposing side surfaces;

each said side surface being narrower than said top surface, said top surface having a width equal to a width of said bottom surface;

said plurality of wooden boards positioned with at least one of said side surfaces of each said wooden board in parallel abutment to at least one side surface of another said wooden board;

said top surfaces of said wooden boards being co-planar;

at least three bores extending through said plurality of wooden boards;

at least three spaced helical pins extending transversely through and imbedded in said bores in said plurality of wooden boards, normal to said opposing side surfaces; and said plurality of wooden boards being held together in compression by said helical pins.

8. A composite scaffolding plank as in claim 7, further comprising:

all said first end surfaces of said plurality of wooden boards being co-planar; and all said second end surfaces of said plurality of wooden boards being co-planar.

9. A composite scaffolding plank as in claim 8, wherein said plank has a nominal height of 2" and a combined nominal width of 10".

10. A composite scaffolding plank as in claim 9 wherein said plurality of wooden boards comprise a first wooden board, a second wooden board and a third wooden board.

11. A composite scaffolding plank as in claim 10, wherein:

said top surface and said bottom surface of said first wooden board have a nominal width of 4";

said top surface and said bottom surface of said second wooden board have a nominal width of 3";

said top surface and said bottom surface of said third wooden board have a nominal width of 4";

said opposing side surfaces of said first wooden board have a nominal height of 2";

said opposing side surfaces of said second wooden board have a nominal height of 2"; and said opposing side surfaces of said third wooden board have a nominal height of 2".

12. A composite scaffolding plank as in claim 7, wherein all said lengths of said plurality of wooden boards are approximately equal.

13. A composite scaffolding plank as in claim 7, wherein said plurality of wooden boards comprises a middle board and two outer boards;

said plurality of wooden boards each having a wood grain direction; wherein said middle board is oriented such that the direction of said wood grain of said middle board alternates against said wood grain direction of said two outer boards.

* * * * *